United States Patent [19]

Peterson et al.

[11] Patent Number: 4,606,409

[45] Date of Patent: Aug. 19, 1986

[54] FLUID PRESSURE ACTUATED FIRING MECHANISM FOR A WELL PERFORATING GUN

[75] Inventors: Elmer R. Peterson, Houston; Gregg W. Stout, Montgomery, both of Tex.

[73] Assignee: Baker Oil Tools, Inc., Houston, Tex.

[21] Appl. No.: 743,045

[22] Filed: Jun. 10, 1985

[51] Int. Cl.[4] ..... E21B 43/116

[52] U.S. Cl. ..... 166/297; 166/55

[58] Field of Search ..... 166/297, 298, 55, 55.1, 166/381, 386, 387; 175/4.52, 4.56; 102/325, 326, 329

[56] References Cited

U.S. PATENT DOCUMENTS

| | | | |
|---|---|---|---|
| 4,345,646 | 8/1982 | Terrell | 166/297 X |
| 4,484,632 | 11/1984 | Vann | 166/297 |
| 4,512,406 | 4/1985 | Vann et al. | 166/297 |
| 4,526,233 | 7/1985 | Stout | 166/55 X |
| 4,538,680 | 9/1985 | Brieger et al. | 166/55 |
| 4,544,034 | 10/1985 | George | 166/55.1 X |

*Primary Examiner*—Stephen J. Novosad
*Assistant Examiner*—Thuy M. Bui
*Attorney, Agent, or Firm*—Norvell & Associates

[57] ABSTRACT

A compressed fluid pressure actuated firing mechanism for a well perforating gun comprises a hollow housing assembly defining a mounting for a primer, a hammer releasably secured above the primer for movement towards the primer, and a fluid pressure chamber associated with the hammer for effecting a compressed fluid pressure force on the latching mechanism for the hammer and on the hammer to move it into impact engagement with the primer. The fluid pressure applied to the hammer is produced by permitting a selected fluid pressure surrounding the fluid pressure chamber to be forced into the fluid pressure chamber through at least one unidirectional check valve, thus compressing the fluid pressure within the fluid pressure chamber. The upper portions of the hammer are in contact with this compressed fluid pressure and the lower portions of the hammer are in contact with the selected fluid pressure. Thus, a subsequent decrease in the selected fluid pressure allows the trapped fluid pressure to expand sufficiently to effect the release and firing movement of the hammer.

21 Claims, 9 Drawing Figures

FLUID PRESSURE ACTUATED FIRING MECHANISM FOR A WELL PERFORATING GUN

BACKGROUND OF THE INVENTION

1. Field of the Invention

The invention relates to a firing mechanism for a gun utilized to effect the perforation of a subterranean well casing or liner through the application of a fluid pressure force to the firing mechanism.

2. Description of the Prior Art

Perforating guns have long been employed to effect the perforation of a well casing or liner in the vicinity of a production zone and to produce fractures extending into such production zone. The popular perforating guns now uniformly employ the so-called "shaped charges", which are disposed in vertically and angularly spaced relationship relative to the casing axis so as to produce a large number of evenly spaced perforations with a single firing. Such shaped charges are generally ignited by a primer cord which contacts a primer end of each shaped charge container to detonate the charge contained within each such container.

The ignition of the primer cord is commonly accomplished by dropping a weight or bar on an impact actuated primer or detonator which is stationarily positioned immediately above the perforating gun housing and is operatively connected to the primer cord which extends downwardly through the perforating gun housing. The employment of a detonating bar dropped through a tubular conduit as a means for effecting the ignition and discharge of the perforating gun has encounttered difficulties in those wells wherein the well bore deviates substantially from the true vertical when passing through a particular production zone. The deviation may be sufficiently great that the fall speed of the detonating bar is substantially reduced, to the point that insufficient impact energy is imparted to the primer charge to effect its discharge. In other wells where it is necessary to employ a high-density kill fluid or the like, the existence of such fluid in the conduit bore, through which the the detonating bar is dropped, can very well reduce the speed of the detonating bar to an ineffective level. Debris collecting around the hammer can have the same effect. Any failure to detonate the primer charge obviously imposes a substantial cost and time penalty on the completion of the well.

It has previously been proposed that the actuation of the hammer to fire the primer charge be effected by fluid pressure forces establishing a differential between the fluid pressure existing in the tubing string carrying the perforating gun versus the fluid pressure existing in the annulus around such tubing string, but when utilizing such fluid pressures to effect the actuation of the hammer of the perforating gun, another factor must be taken into account, namely the desirability of perforating the well with the fluid pressure existing in the casing annulus adjacent the zone to be perforated being maintained at a relatively low level so that the perforating of the adjoining production formation is accomplished with the well in the so-called "underbalanced" condition. In other words, the anticipated fluid pressure of fluid from the perforated production zone should desirably be in substantially excess of the fluid pressure existing within the well casing at the moment that perforation is accomplished, so that flow from the peforated production zone can immediately commence with a substantial velocity and thus remove the debris naturally associated with the perforating operation from the perforations in the production formation.

Such underbalanced condition is commonly produced by suspending the perforating apparatus from a tubing-carried packer which is set at a position above the production zone to be perforated. A cross-over sub is then provided to divert the fluid transmitted by the tubing bore into the casing annulus below the packer for the reason that it is much easier to reduce the fluid pressure existing in the annulus adjacent the production zone to be perforated by a swabbing operation in the tubing string. The annulus fluid pressure existing above the packer is transmitted to the firing mechanism for the perforating gun by an axially extending fluid passage provided in the packer. Thus an increase in annulus pressure accompanied by a simultaneous decrease in tubing pressure will produce a pressure differential sufficient to cause the fluid pressure actuation of the hammer of the firing mechanism, while at the same time producing an underbalanced condition in the casing annulus adjacent the production zone to be perforated. A fluid pressure actuated firing mechanism for a perforating gun of this general type is disclosed and claimed in co-pending application, Ser. No. 593,396, filed Mar. 26, 1984, and assigned to the Assignee of the present invention now U.S. Pat. No. 4,594,335.

A fluid pressure actuating mechanism for a perforating gun which is operable solely by changes in the selected fluid pressure would obviously provide a simplified system for effecting the fluid pressure actuation of a well perforating gun.

SUMMARY OF THE INVENTION

In a preferred format of the invention, The invention provides a perforating gun assembly comprising a tubular work string having a packer mounted at the end thereof; a fluid pressure actuated firing means mounted in a first housing depending from the packer, and the perforating gun comprising the plurality of shaped charges mounted in a second housing depending from the first housing. The first housing contains a fixedly mounted primer charge and conventional means, such as a primer cord, is employed for transmitting the detonating energy of the primer charge to the shaped charges contained in the lower second housing. The first housing further defines a fluid pressure chamber above the primer charge within which a hammer is slidably and sealably mounted. The top end of the fluid pressure chamber, which would normally be in communication with the bore of the packer and the supporting tubing string is closed at its upper end by a frangible barrier at the location below the casing seal elements of the packer. In a preferred embodiment of the invention, radial ports are provided above the frangible barrier to place the bore of the tubing string in fluid communication with the casing annulus below the packer. Thus the fluid pressure in the casing annulus adjacent to the production zone to be perforated is determined by the tubing pressure.

Two fluid conduits are provided at opposite ends of the fluid pressure chamber, hence above and below the hammer, to provide communication between the ends of the fluid pressure chamber and the casing annulus located below the packer. The fluid conduit for the upper end of the fluid pressure chamber includes one or more check valves which function to permit flow of pressured fluid only in the direction into the fluid pressure chamber. A releasable latching mechanism secures the hammer in an intermediate position between the two fluid pressure conduits and in an elevated position relative to the primer charge.

Accordingly, when the fluid pressure in the tubing string is increased, the fluid pressure above and below the hammer is correspondingly increased and no movement of the hammer is produced. The latching mechanism is constructed to to retain the hammer in such intermediate, inoperative position until a sufficient fluid pressure differential exists above the hammer to insure that it will be driven downwardly with sufficient force to effect the detonation of the primary charge.

The necessary fluid pressure differential to effect the release of the latching mechanism and the actuation of the hammer is derived by then reducing the fluid pressure in the tubing string or in the casing annulus above the packer, to the level desired for effecting the perforation of the well in an underbalanced condition. Such reduction in fluid pressure concurrently effects a reduction in the fluid pressure below the hammer, but the fluid pressure above the hammer is trapped due to the provision of the check valves in the fluid supply conduit. Thus, as the tubing pressure is reduced, the fluid pressure differential above the hammer is increased until it reached a level to cause the disengagement of the releasable latching means and the driving of the hammer downwardly into impact engagement with the primer charge. The detonation of the primer charge effects the ignition of the primer cord, and the primer cord in turn effects the detonation of the shaped charges disposed in the second housing.

The apparatus embodying this invention has the further advantage of providing a backup mechanical actuation of the firing mechanism in the event that the fluid pressure actuation of the hammer does not, for any reason, produce the detonation of the primer charge. It will be recalled that the upper end of the fluid pressure chamber is defined by a frangible barrier. The dropping of a detonating bar through the tubing string will effect the shattering of this frangible barrier and the bar will impact on the hammer and hence impart impact energy to the primer charge sufficient to effect its detonation. Thus, the well operator has a second chance of effecting the firing of the perforating gun without removing any of the equipment from the well.

In the unlikely event that neither the fluid pressure actuation nor the mechanical actuation of the firing mechanism is successful, the firing mechanism embodying this invention has the further advantage in that it provides utmost safety to the operator when the entire perforating gun and firing mechanism is removed from the well for repair. The shattering of the frangible barrier forming the upper end of the fluid pressure chamber insures that no fluid pressure differential can exist across the hammer and thus, the danger of the hammer being subjected to fluid pressure forces to fire the primer charge as the gun is being removed from the well, is eliminated.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
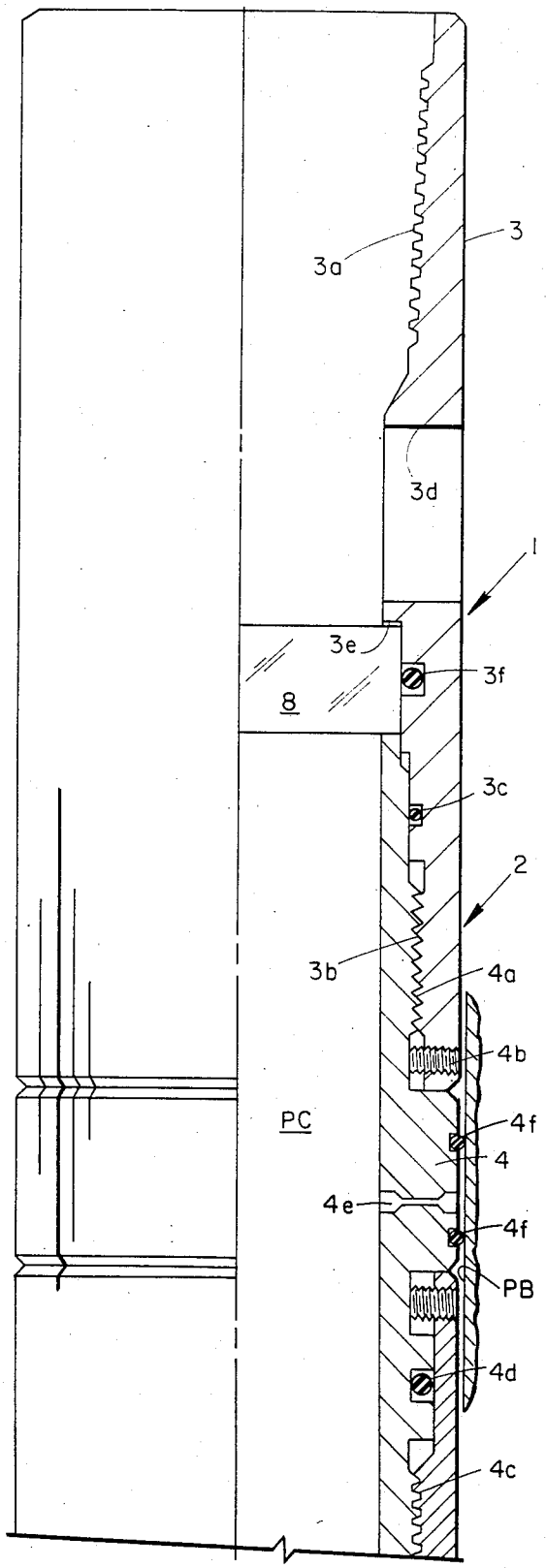
FIGS. 1A, 1B, 1C, 1D, and 1E collectively represent a vertical, sectional view of a fluid pressure actuated firing mechanism for a subterranean well perforating gun.

Referring to the drawings, there is shown a fluid actuated firing mechanism 1 comprising a tubular housing assembly 2 which is normally connected at its upper end to a conventional packer (not shown) which is set in the well casing (not shown) at a location above the production zone to be perforated, and at its lower end is connected to any conventional form of perforating gun 20, of which only the top portion thereof is shown. The tubular housing assembly 2 comprises at its upper end a barrier mounting sub 3 having internal threads 3*a* for connection to the lower portion of a tubular conduit. At its lower end, the barrier mounting sub 3 is provided with internal threads 3*b* for connection to the external threads 4*a* of a connecting sub 4. An O-ring 3*c* seals this threaded connection and a set screw 4*b* prevents rotation of the threads.

The lower end of connecting sub 4 is provided with external threads 4*c* and an O-ring 4*d* to provide a sealed, threaded connection to a length of space-out tubing 5. The lower end of tubing 5 is provided with internal threads 5*a* for effecting a connection with the upper end of a detonating bar guide sub 6. An O-ring 6*a* seals this threaded connection and a set screw 5*b* prevents disengagement of the threads. The lower end of the guide sub 6 is provided with internal threads 6*b* for effecting a threaded connection to the upper end of a fluid pressure charging sub 7 within which check valves 9 are mounted, in a manner to be hereinafter described. O-ring 7*a* and set screw 7*b* secure this threaded connection. At the lower end of charging sub 7, internal threads 7*k* effect a threaded connection to a hollow hammer mounting housing 10 which is sealed by O-rings 7*m*. Housing 10 is provided at its lower end with external threads 10*k* and O-rings 10*m* for effecting a sealed connection to a booster chamber sub 11. The lower portion of booster chamber sub 11 is provided with internal threads 11*a* for effecting a connection to the top of a conventional perforating gun 20.

Figure 4:
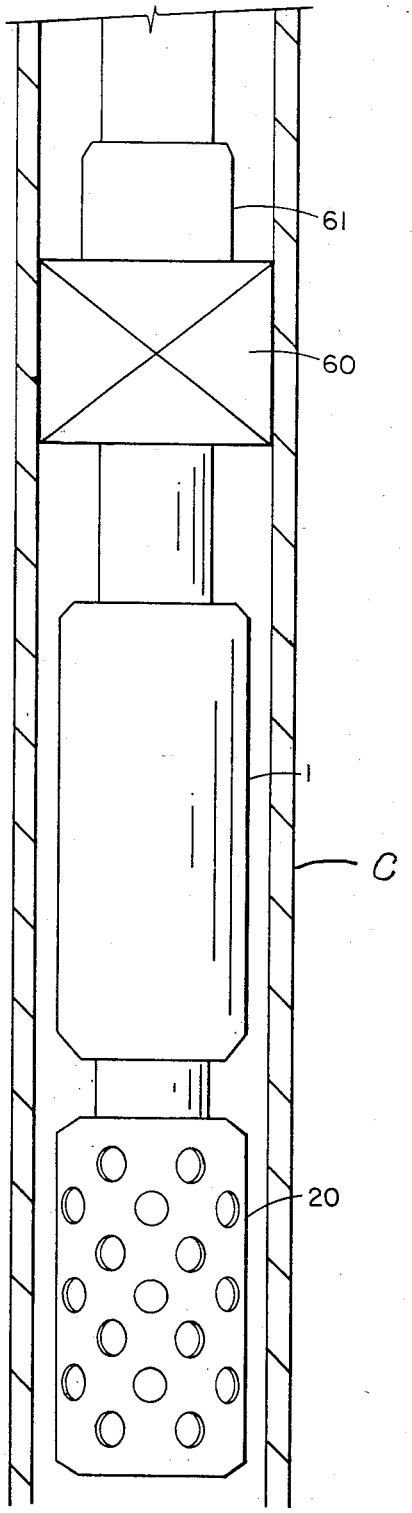
FIG. 4 is a schematic elevational view of the apparatus of this invention supported in a well by a packer.

As is well-known to those skilled in the art, the entire assemblage heretofore described is normally mounted in depending relationship to a packer 60 (FIG. 4) and the packer is set by a conventional setting mechanism 61 at a location in the well casing c so as to position the perforating gun adjacent the production formation to be perforated. The packer is carried into the well on a tubing string or may be stabbed into a polished bore receptacle, by wire line, or the like, and the bore of the tubing string communicates with the bore of the packer and in turn with the bore of the barrier sub 3.

Barrier sub 3 is provided with a plurality of radial ports 3*d* around its circumference. Immediately below the radial ports 3*d*, barrier sub 3 defines a downwardly facing surface 3*e*. A frangible barrier 8, which is preferably formed of glass or frangible ceramic is secured between the downwardly facing shoulder 3*e* and the top end of the connecting sub 4. An O-ring 3*f* provides a seal between the barrier 8 and the barrier sub 3. Thus, any pressured fluids supplied through the tubing string will enter only the top portions of the barrier sub 3 and then be diverted through the radial ports 3*d* into the annulus between the tubular assembly 2 and the well casing.

Figure 1B:
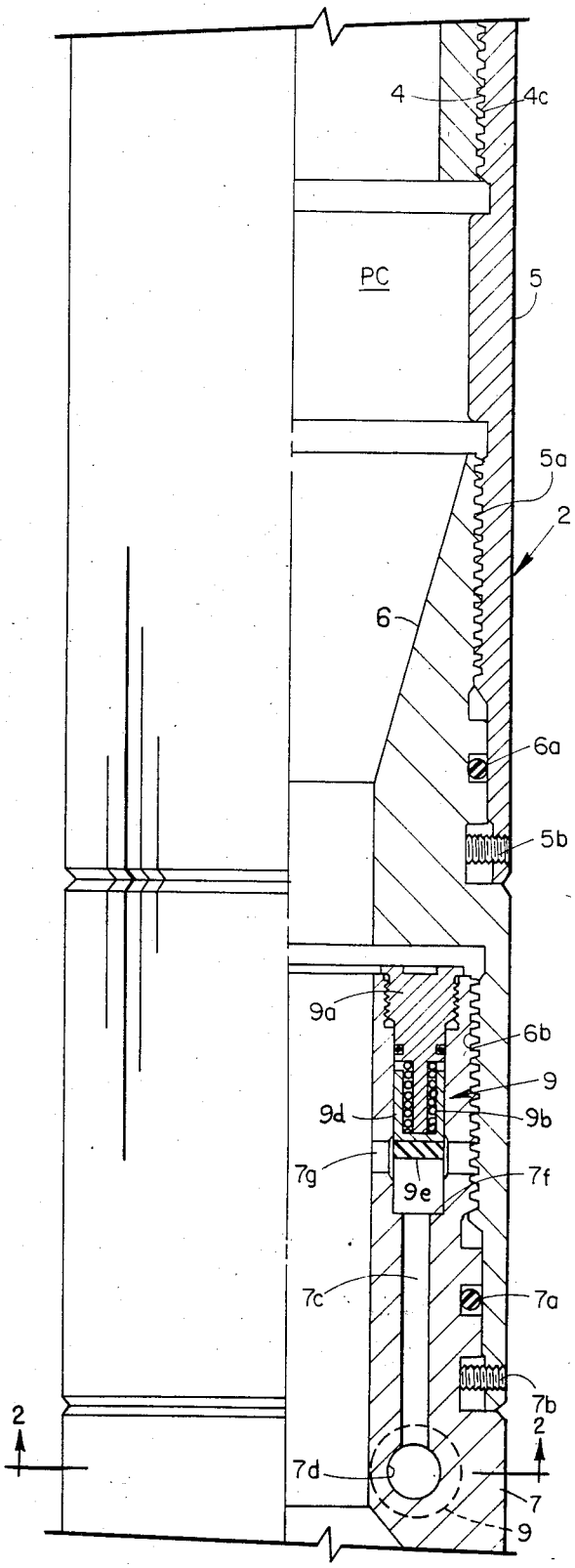
Figure 2:
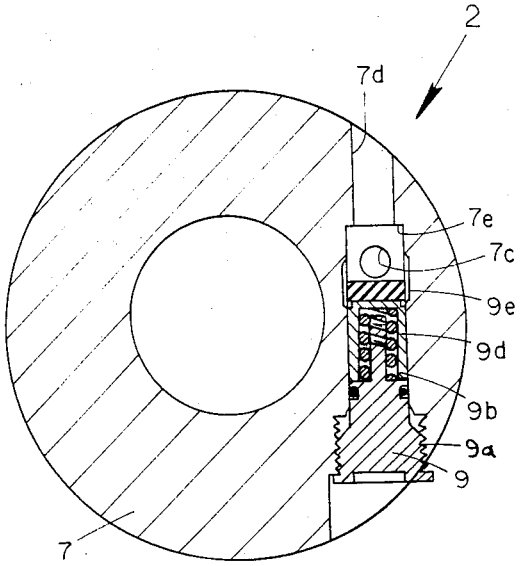
FIG. 2 constitutes a sectional view taken on the plane 2—2 of FIG. 1B.

Between the barrier sub 3 and the internal bore of the hammer mounting housing 10, a fluid pressure chamber PC is defined. Pressured fluid is supplied to this fluid pressure chamber through the utilization of one or more check valves 9 mounted in the charging sub 7. In the preferred embodiment of the invention, charging sub 7 is provided with an axially extending fluid passage 7*c* communicating with a horizontally extending fluid passage 7*d* which projects through the wall of the charging sub 7 to communicate with the casing annulus. (FIG. 2) An identical check valve 9 is mounted in each of the fluid passages 7*d* and 7*c* and comprises a plug element 9*a* threadably secured in the end of the respective fluid passage and supporting a spring 9*b* which urges a valving head 9*d*, having an elastomeric sealing surface 9*e*, into engagement with a shoulder 7*e*, in the case of fluid passage 7*d*, and a shoulder 7*f* in the case of fluid passage 7*c*. A radial port 7*g* communicates with the fluid passage 7*c* at a position which is normally blocked by the check valve 9. In the positions of the check valves 9 illustrated in FIG. 1B and FIG. 2, the valves are in their open or pressurized position, thus permitting unrestricted fluid flow from the casing annulus through the fluid passage 7*d*, thence into the fluid passage 7*c* and thence into the port 7*g* to supply pressured fluid to the fluid pressure chamber PC. When the fluid pressure in the pressure chamber PC equals the casing annulus pressure, both of the check valves 9 will close and thus the pressured fluid in fluid pressure chamber PC will be trapped and will remain at its maximum value. The two check valves 9 are employed in series relationship to better insure that the trapped fluid pressure will not be inadvertently lost through leakage through one of the valves.

In order to prevent a build-up of pressure within the pressure chamber PC during the insertion of the perforating gun 20 and firing mechanism 1 into the well, a pressure relief bleed aperture 4*e* is provided in the wall of connecting sub 4. Aperture 4*e* is straddled on its exterior by two axially spaced seals 4*f*, and these seals engage a seal bore surface PB such as the seal bore extension commonly associated with a downhole mounted packer. Thus, when the perforating gun 20 and the firing mechanism 1 are positioned in the seal bore extension preliminary to firing of the perforating gun 20, the pressure bleed opening 4*e* is closed and the pressure within the fluid pressure chamber PC is determined by the pressured fluid supplied from the casing annulus below the packer through fluid passages 7*c* and 7*d*. This may require movement of the tubing string relative to the set packer which is accomplished in any conventional manner.

As previously mentioned, the lower end of the charging sub 7 is provided with external threads 7*k* for engagement with external threads provided on the top of a hollow hammer housing 10 which contains the hydraulic firing mechanism. A pair of O-rings 7*m* effects the sealing of the threaded connection. The hollow body element 10 defines a central bore 10*b* which is in communication with the fluid pressure chamber PC and the lower portion of bore 10*b* is slightly enlarged as shown at 10*c*.

A primer mounting sleeve 30 is sealably inserted within the bottom end of the hollow housing 10 by internal threads 10*d* and O-ring seal elements 30*a* provided on the exterior of the primer mounting sleeve 30. A hollow plug 31 is in turn threadably mounted in the bottom of the primer mounting sleeve 30 by threads 31*a* and the threaded connection is sealed by an O-ring 31*b*. Plug 31 holds an impact detonable primer element 32 in snug engagement with a downwardly facing shoulder 30*b* formed on the interior of the sleeve 30. O-ring 30*e* seals this abutting connection and an O-ring 32*a* seals the bottom of the primer 32 against the upwardly facing end surface of the plug 31.

Plug 31 is provided with an internal bore 31*c* and a booster charge 33 is mounted in such bore and is conventionally connected to a short length of primer cord 34 extending downwardly through the bore of the connecting sub 11 and terminating in a second booster charge 35. Booster charge 35 is spaced immediately above a booster charge 36 conventionally provided in a coupling 25 mounted on the top end of the perforating gun 20 and providing an operative connection with the primer cord 26 which extends through the gun to ignite all of the shaped charges 21 mounted therein.

Primer 32 is normally detonated by the pointed end 40*a* of a fluid pressure actuated hammer 40. The hammer has an enlarged top end portion 41 which slidably engages the bore 45*b* of the top ring portion 45*a* of a collet 45.

The flexible arm portions 45*c* of the collet 45 extend downwardly in parallel relationship to the hammer 40 and are provided with a thickened portion 45*d* along the length thereof which defines an inwardly projecting latching surface 45*e* which cooperates with a similarly inclined downward facing surface 42 provided on the hammer 40 so as to retain the hammer 40 in an elevated position relative to the primer 32. Thus, sufficient fluid pressure force must be applied to the hammer 40 to cause the inclined surfaces 42 to cam the collet arms 45*c* outwardly to release the hammer to travel downwardly and impact primer 32. It will be noted that the bottom end of the collet arms 45*c* terminate in a solid ring 45*g*.

To prevent any premature movements of the hammer 40 toward the primer charge 32, a locking sleeve piston 46 is provided which is slidably and sealably mounted within the bore 10*b* of housing 10. Locking sleeve piston 46 is normally positioned adjacent an outwardly projecting rib 45*f* formed on each of the collet arms 45*c* and thus positively prevents any outward displacement of the collet arms 45*c*. Locking sleeve piston 46 is secured in its locking position by a shear screw 46*c* which traverses the wall of the housing 10 and engages an annular groove 46*d* provided in such locking sleeve 46.

A sealing sleeve 47 is mounted in the housing bore 10*c* immediately below the locking sleeve piston 46 and is sealably engaged with such bore at its upper end by an O-ring 47*a*. The lower end 47*b* of the sealing sleeve is of reduced diameter and mounts an O-ring seal 47*c* which sealably engages the lower portion of the hammer 40. Thus, fluid pressure existing in the overlying fluid pressure chamber PC is applied to the hammer 40 to exert a downward force thereon. The lower end 47*b* of the sealing sleeve 47 is threadably engaged with internal threads 30*c* formed on the upper end of primer mounting sleeve 30.

A fluid passage 10*e* is provided in the wall of housing 10 and permits fluid pressure from the casing annulus surrounding the housing assembly 2 to be applied to the lower portions of the hammer 40 through a radial port 30*d* provided in the primer mounting sleeve 30. Thus, the upper portion 41 of hammer 40 is exposed to the fluid pressure existing in the fluid pressure chamber PC, while the lower portion of hammer 40 is exposed to the fluid pressure existing in the casing annulus below the packer (not shown).

Figure 1C:
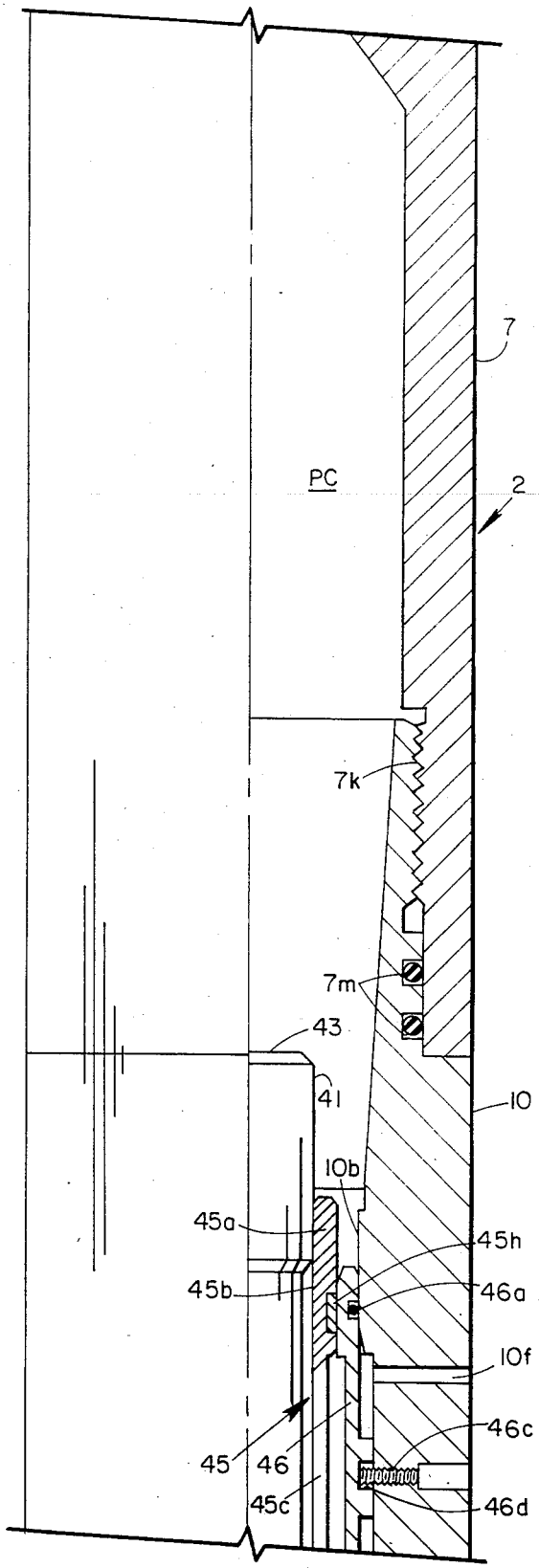
Figure 1D:
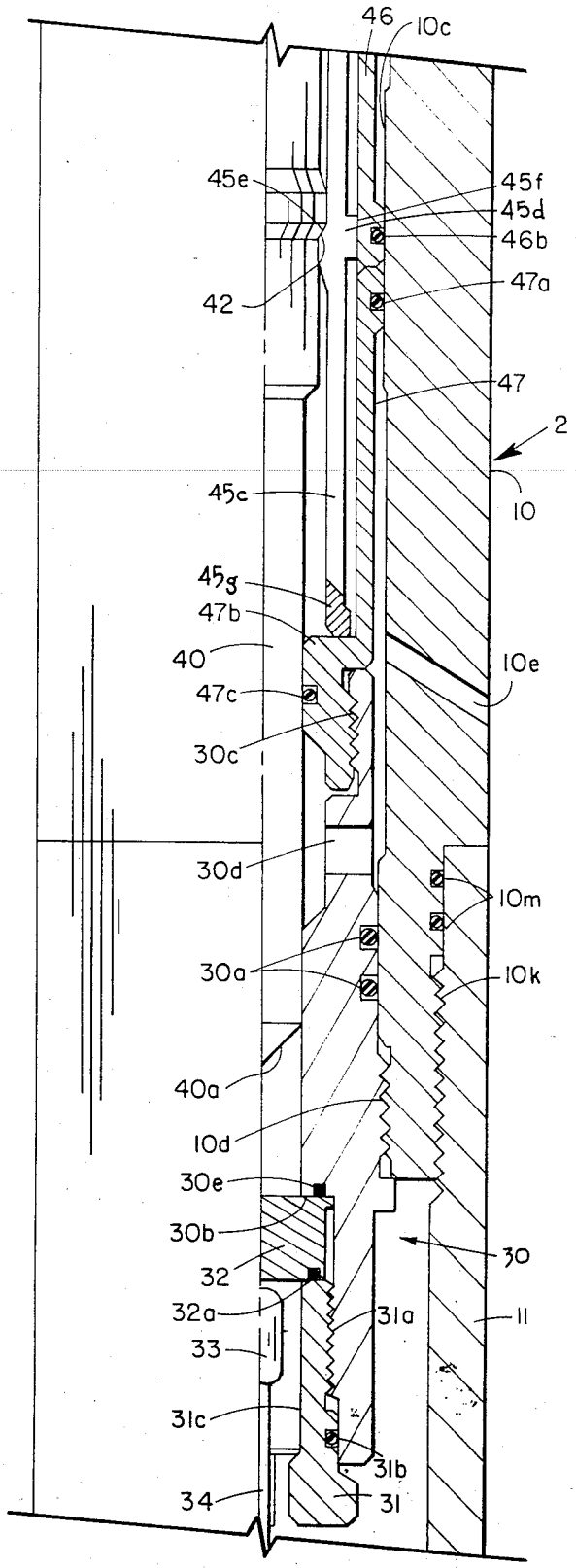
Figure 1E:
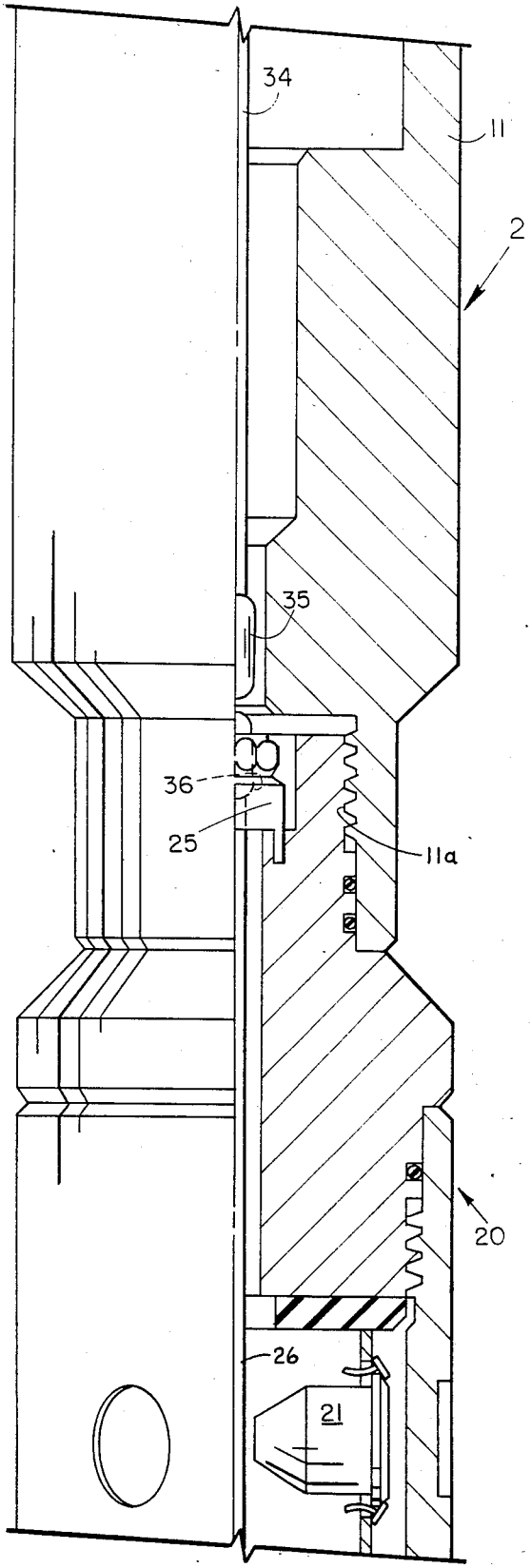
Figure 3A:
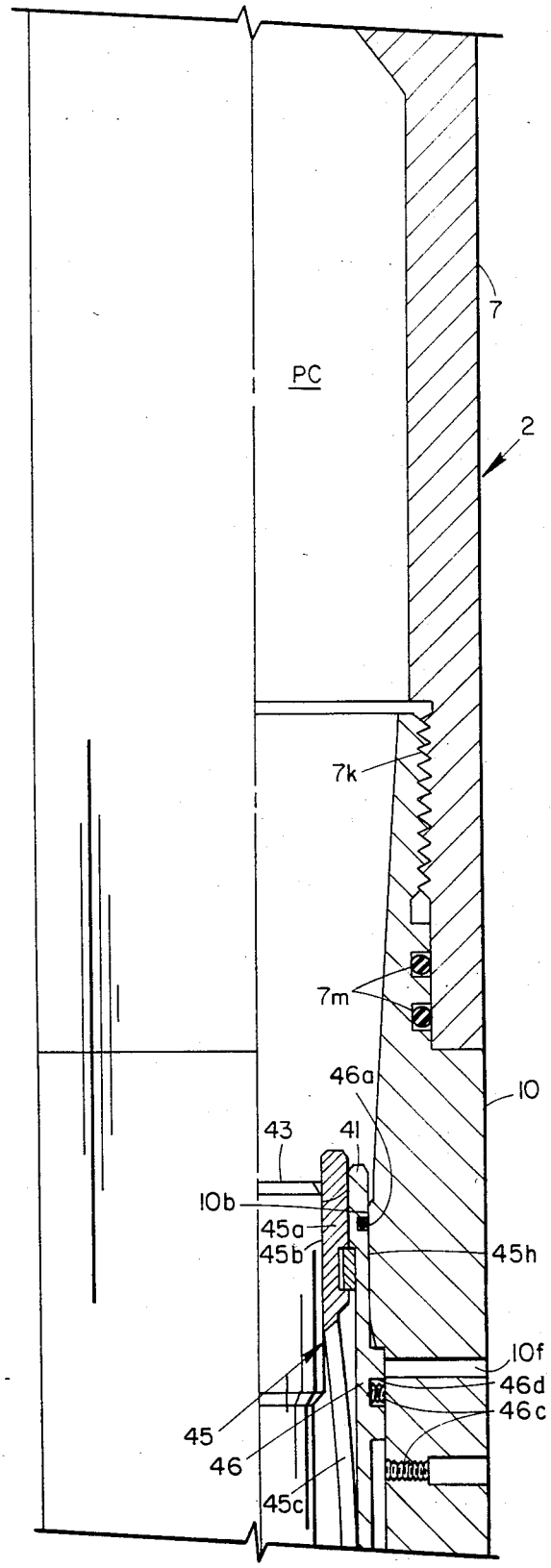
FIGS. 3A and 3B are views respectively similar to FIGS. 1C and 1D but showing the hammer position after firing.
Figure 3B:
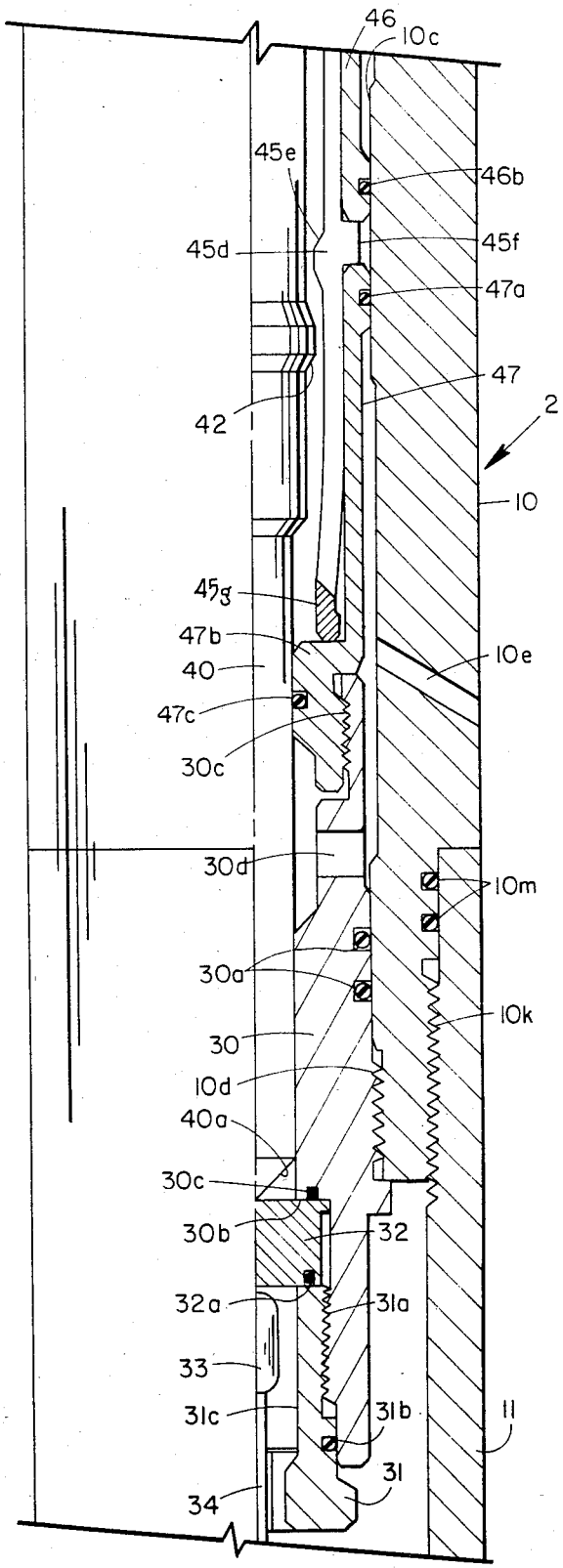

Additionally, a radial port 10*f* (FIG. 1C) is provided in the hollow housing 10 at a position intermediate O-ring seals 46*a* and 46*b* provided on the exterior of the locking sleeve piston 46. These seals contact the bore walls 10*b* and 10*c* respectively at different diameters, and hence, when the fluid pressure in the fluid pressure chamber PC exceeds the fluid pressure existing in the annulus surrounding the tubular housing assembly 2, an upward force will be exerted on the locking piston 46. When such force reaches a predetermined level, corresponding to the desired amount of pressure differential to be exerted on the hammer 40, the shear pin 46*c* is sheared and the locking sleeve piston 46 moves upwardly to the position illustrated in FIGS. 3A and 3B, thus permitting the hammer 40 to cam the collet arms 45*c* outwardly and drive down into impact engagement with the primer 32. Locking sleeve piston 46 is retained in such released position by an expandable C-ring 45*h* carried on the ring portion 45*a* of collet 45.

The operation of the aforedescribed fluid pressure actuated firing mechanism will be readily apparent to those skilled in the art. The fluid pressure in the casing annulus surrounding the housing assembly 2 is first increased. If the aforedescribed firing mechanism and perforating gun are mounted below a packer, as is customary, the frangible barrier 8 and the radial ports 3*d* will be located below the seal elements of such packer and hence the tubing string pressure will be supplied to the casing annulus below the packing. Such pressured fluid enters the fluid pressure chamber PC through the unidirectional check valves 9 provided in the fluid passages 7*d* and 7*c* and raises the fluid pressure in such fluid pressure chamber to the level existing in the casing annulus below the packer. The tubing pressure may then be decreased by bleeding off the pressure. A further decrease, if desired, can be obtained by swabbing operations in the tubing string. In any event, the fluid pressure in the casing annulus surrounding the housing assembly 2 will be substantially reduced below the level of the pressured fluid trapped within the fluid pressure chamber PC. When the fluid pressure differential across the hammer 40 reaches a desired level, the locking sleeve piston 46 is shifted by such fluid pressure differential, shearing the shear pin 46*c*. The hammer 40 can then cam the collet arms 45*c* outwardly and drive down into impact engagement with the primer 32 under the force of the differential fluid pressure.

The detonation of primer 32 effects the detonation of the booster charge 33 and in turn the ignition of the intermediate primer cord 34 which travels down the primer cord 34 to detonate the booster charge 35. Detonation of booster charge 35 will effect the detonation of the booster charge 36 contained within the upper end of the perforating gun 20, thus effecting the detonation of the primer cord 26 extending through the perforating gun 20 to detonate each of the shaped charges 21 mounted therein.

Another feature of this invention is notable in the event the application of the differential fluid pressure to the hammer 40 fails to effect the detonation of the primer 32. A second impact blow may be applied to the primer 32 through the simple expedient of dropping a detonating bar (not shown) through the tubing string which will travel downwardly and impact on the upper end 43 of the hammer 40 which projects above the bore 10*b* of the hollow housing 10 sufficiently to be engaged by such detonating bar. Since many primers will discharge after being subjected to a cumulative amount of impact force, such additional impact force applied to the hammer 32 may be successful in effecting its detonation, thus eliminating the need for removal of the perforating gun and firing mechanism from the well. In any event, it is desirable that the frangible barrier 8 be broken by a detonating bar or a wireline tool prior to removal of the firing mechanism from the well in order to remove any fluid pressure from the fluid pressure chamber PC which might cause the inadvertent firing of the primer charge 32 as the firing mechanism is being removed from the well. Thus, the removal of the firing mechanism and perforating gun may be accomplished with an added degree of safety not previously available in prior art mechanism.

The aforedescribed hydraulic firing mechanism may be employed to effect the firing of a fluid pressure actuated firing mechanism of a redundant firing mechanism, incorporating both mechanical and a fluid pressure actuated firing mechanism and separate primers associated therewith. A redundant firing mechanism of this type is described and claimed in my co-pending application, Ser. No.: 743,044, filed concurrently herewith.

It will be appreciated that, while a preferred embodiment utilizes means to direct fluid flow from the tubing into the casing annulus below the packer, such means, including value components, can be easily modified to direct fluid flow from the casing annulus above the packer into the tubing string below the packer.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An actuator for a well perforating gun having a primer detonable by the application of impact energy comprising: a housing fixedly supporting the primer; said housing defining a fluid pressure chamber adjacent the primer; firing means sealably and shiftably mounted in said fluid pressure chamber for movement relative to the primer; latching means for releasably securing said firing means in spaced relation to the primer and intermediate the ends of said fluid pressure chamber; first and second fluid passages communicating respectively between opposite ends of said fluid pressure chamber and a source of pressured fluid; one of said fluid passages having valve means mounted therein to permit flow of pressured fluid only into the end of said fluid pressure chamber remote from the primer, whereby an increase in pressure of the fluid pressure source followed by a decrease in pressure produces a trapped fluid pressure force on said firing means sufficient to release said firing means from said latching means and cause said firing means into relative impact engagement with the primer.

2. The apparatus of claim 1 wherein said housing is communicable with the bottom of a tubing string through which said pressured fluid is supplied; a frangible barrier separating the upper end of said fluid pressure chamber from the bore of said tubing string; and port means in said tubing string above said frangible barrier for transmitting said pressured fluid around said frangible barrier to said first and second conduit means, whereby the dropping of a detonating bar will shatter said frangible barrier and apply an impact blow to said firing means.

3. The apparatus of claim 2 wherein said firing means comprises a hammer slidably and sealably mounted in said fluid pressure chamber.

4. The apparatus of claim 3 wherein said latching means comprises a locking piston shiftably mounted in said fluid pressure chamber and engagable with said latching means in one position to lock said latching means in engagement with said hammer; shearable means securing said locking piston in said one position; said locking piston being shiftable from said one position by said subsequent decrease in pressure of said pressured fluid.

5. The apparatus of claim 1 wherein said firing means comprises a hammer slidably and sealably mounted in said fluid pressure chamber.

6. The apparatus of claim 5 wherein said latching means comprises a locking piston shiftably mounted in said fluid pressure chamber and engagable with said latching means in one position to lock said latching means in engagement with said hammer; shearable means securing said locking piston in said one position; said locking piston being shiftable from said one position by said subsequent decrease in pressure of said pressured fluid.

7. The apparatus of claim 1 further comprising bleed port means in said remote end of said fluid pressure chamber for bleeding off to the well bore any fluid pressure differential created in said fluid pressure chamber by insertion into the well; and means for sealing said port means when said actuator is positioned in firing position in the well.

8. A tubing carried perforating gun for a subterranean well, comprising: a first housing for supporting a plurality of shaped charges in vertically and angularly spaced relation; a second housing mounted above said first housing; a primer charge fixedly mounted in the lower portion of said second housing; means for transmitting the detonation energy of said primer charge to said shaped charges; said second housing being attachable to a tubing string and defining a fluid pressure chamber, a hammer slidably and sealably mounted in said fluid pressure chamber, whereby a fluid pressure above said hammer in excess of the fluid pressure below said hammer will cause said hammer to impact said primer charge; a check valve mounted in the upper portions of said fluid pressure chamber permitting flow of pressured fluid only into said fluid pressure chamber; means for supplying a pressured fluid from one of (1) the tubing string, and (2) the annulus surrounding said housing, to the other of the tubing string and the annulus surrounding said housing; and means for effecting communication of the portion of said fluid pressure chamber below said hammer to said one of the tubing string and said annulus, whereby an increase in pressure of said pressured fluid establishes a trapped fluid pressure in said fluid pressure chamber above said hammer and a subsequent decrease in pressure of said pressured fluid produces a downward force on said hammer.

9. The apparatus of claim 8 further comprising releasable latching means for securing said hammer in an elevated position relative to said primer charge, whereby said hammer is not released until a downward fluid pressure force adequate to detonate said primer charge is exerted on said hammer.

10. The apparatus of claim 9 further comprising a locking piston shiftably mounted in said fluid pressure chamber and engagable with said latching means in one position to lock said latching means in engagement with said hammer; shearable means securing said locking piston in said one position; said locking piston being shiftable from said one position by said subsequent decrease in pressure of said pressured fluid.

11. The apparatus of claim 8, 9 or 10 wherein a frangible barrier separates the upper end of said fluid pressure chamber from the bore of the tubing string, said frangible barrier being disposed below said first conduit means, whereby upon failure of said hammer to fire said primer charge by fluid pressure actuation, a detonating bar may be dropped through the tubing string to shatter said frangible barrier and impact on said hammer.

12. A tubing carried casing perforating apparatus for a subterranean well comprising a packer communicable with the interior of a tubular string; means for setting said packer at any selected location in the well casing; a first hollow housing assembly sealably extendable to said packer; a primer charge mounted in the lower portion of said first housing assembly; a second housing assembly dependently secured to said first housing assembly; a plurality of shaped charges mounted in said second housing assembly in vertically and angularly spaced relationship; means for transferring detonating energy of said primer charge to said shaped charges to detonate same; said first housing assembly defining a fluid pressure chamber above said primer charge; means at the upper end of said fluid pressure chamber for diverting fluid flow from one of: (1) the tubing string; and (2) the casing annulus above the packer into one of: (1) the tubing string; and (2) the casing annulus above said packer, below said packer; a hammer slidably and sealably mounted in said fluid pressure chamber; releasable latching means for securing said hammer in an elevated position relative to said primer charge, whereby the application of a predetermined fluid pressure differential above and below said hammer will force said hammer downwardly to produce an impact below on said primer charge to detonate same; a check valve mounted in said fluid pressure chamber above said hammer permitting only flow of pressured fluid to enter said fluid pressure chamber; whereby pressured fluid supplied through one of the tubing string and said annulus below said packer will be trapped above said hammer; and conduit means in said first housing assembly connecting the casing annulus with said fluid pressure chamber below said hammer, whereby a reduction in fluid pressure will produce a pressure differential on said hammer to move said hammer into impact engagement with said primer charge.

13. The apparatus of claim 12 further comprising a locking piston shiftably mounted in said fluid pressure chamber and engagable with said latching means in one position to lock said latching means in engagement with said hammer; shearable means securing said piston in said one position; said piston being shiftable from said one position by said reduction in fluid pressure.

14. The apparatus of claim 12 wherein said means for diverting fluid flow comprises a transversely disposed frangible barrier sealing the upper end of said fluid pressure chamber, whereby the dropping of a detonating bar through the tubing string will shatter said barrier, release said trapped fluid pressure and impact on said hammer to mechanically detonate said primer charge.

15. The apparatus of claim 14 wherein said means for diverting fluid flow from the tubing string further comprises radial ports in said first housing assembly located above said frangible barrier.

16. The apparatus of claim 12 further comprising passage means for bleeding off any fluid pressure differential created in said fluid pressure chamber above said hammer by insertion of said first housing assembly into the well; and means in communication with said packer for sealing said passage means after said packer is set.

17. The method of firing a well perforating gun having an impact detonatable primer at one end of a fluid pressure chamber and a hammer slidably and sealably mounted in said chamber and releasably secured in spaced relation to said primer, the steps of:

(1) providing fluid connections between opposite ends of the fluid pressure chamber and a source of pressured fluid;
(2) trapping pressured fluid entering the end of the fluid pressure chamber remote from the primer charge;
(3) reducing the pressure of the fluid pressure source to create an increasing fluid pressure differential on said hammer urging the hammer toward the primer; and
(4) releasing the hammer to impact the primer when the fluid pressure differential acting on the hammer reaches a predetermined level.

18. The method of firing a tubing carried well perforating gun of the type having a hammer slidably and sealably mounted in a fluid pressure chamber, an impact detonatable primer at the bottom end of the chamber, a frangible barrier separating the upper end of the chamber from the bore of the tubing, and releasable means securing the hammer in an elevated position relative to the primer, comprising the steps of:

(1) providing fluid connections between opposite ends of the fluid pressure chamber and a source of pressured fluid;
(2) trapping pressured fluid entering the end of the fluid pressure chamber remote from the primer charge;
(3) reducing the pressure of the fluid pressure source to create an increased fluid pressure differential on said hammer urging the hammer toward the primer;
(4) releasing the hammer to impact the primer when the fluid pressure differential acting on the hammer reaches a predetermined level; and
(5) in the event the primer fails to detonate, dropping a detonating bar through the tubing string to break the frangible barrier and impact on the hammer, thereby providing a second detonating impact on the primer.

19. The method of firing a well perforating gun carried in depending relation to a packer, said gun having a hammer slidable and sealably mounted in a fluid pressure chamber, an impact detonatable primer at one end of the chamber, and releasable means securing the hammer in spaced position relative to the primer, comprising the steps of:

(1) providing fluid connections between opposite ends of the fluid pressure chamber and the annulus surrounding the chamber;
(2) running the perforating gun into the well to a position adjacent the formation to be perforated;
(3) setting the packer in the well casing, thereby isolating the casing annulus below the packing;
(4) supplying pressured fluid to the casing annulus below the packer, thereby pressurizing both ends of the fluid pressure chamber;
(5) trapping pressured fluid entering the end of the fluid pressure chamber remote from the primer charge;
(6) reducing the fluid pressure in the casing annulus below the packer to a predetermined level, thereby creating a predetermined fluid pressure on the hammer urging the hammer toward the primer; and
(7) releasing the hammer to impact the primer when the fluid pressure acting on the hammer reaches a predetermined level.

20. The method of firing a well perforating gun carried in depending relation to a packer, said gun having a hammer slidably and sealably mounted in a fluid pressure chamber, an impact detonatable primer at the bottom end of the chamber, a frangible barrier separating the upper end of the chamber and releasable means securing the hammer in an elevated position relative to the primer, comprising the steps of:

(1) providing fluid connections between opposite ends of the fluid pressure chamber and the annulus surrounding the chamber;
(2) running the perforating gun into the well to a position adjacent the formation to be perforated;
(3) setting the packer in the well casing, thereby isolating the casing annulus below the packer;
(4) supplying pressured fluid to the casing annulus below the packer, thereby pressurizing both ends of the fluid pressure chamber;
(5) trapping pressured fluid entering the end of the fluid pressure chamber remote from the primer charge;
(6) reducing the fluid pressure in the casing annulus below the packer to a predetermined level, thereby creating a predetermined fluid pressure on the hammer urging the hammer toward the primer;
(7) releasing the hammer to impact the primer the fluid pressure acting on the hammer reaches a predetermined level; and
(8) in the event the primer fails to detonate, dropping a detonating bar through the tubing string to break the frangible barrier and impact on the hammer, thereby providing a second detonating impact on the primer.

21. The method of firing a well perforating gun carried in depending relation to a packer, said gun having a hammer vertically slidably and sealably mounted in a fluid pressure chamber, an impact detonatable primer at the bottom end of the chamber, a frangible barrier separating the upper end of the chamber and releasable means securing the hammer in an elevated position relative to the primer, comprising the steps of:

(1) providing fluid connections between opposite ends of the fluid pressure chamber and the annulus surrounding the chamber;

(2) running the perforating gun into the well to a position adjacent the formation to be perforated;

(3) bleeding through a passage into the well bore any pressure differential created in the upper end of the fluid pressure chamber by insertion into the well;

(4) sealing the passage when the perforating gun is positioned adjacent the formation to be perforated;

(5) setting the packer in the well casing, thereby isolating the casing annulus below the packer;

(6) supplying pressured fluid to the casing annulus below the packer, thereby pressurizing both ends of the fluid pressure chamber;

(7) trapping pressured fluid entering the end of the fluid pressure chamber remote from the primer charge;

(8) reducing a selected fluid pressure to a predetermined level, thereby creating a predetermined fluid pressure differential on the hammer urging the hammer toward the primer;

(9) releasing the hammer to impact the primer when the fluid pressure differential acting on the hammer reaches a predetermined level; and

(10) in the event the primer fails to detonate, dropping a detonating bar through the tubing string to break the frangible barrier and impact on the hammer, thereby providing a second detonating impact on the primer.

* * * * *